US006142897A

United States Patent [19]

Lees

[11] Patent Number: 6,142,897

[45] Date of Patent: Nov. 7, 2000

[54] SMOOTH BASKETBALL

[75] Inventor: Charles W. Lees, Milford, Mass.

[73] Assignee: HoopMaster, Inc., Milford, Mass.

[21] Appl. No.: 09/161,077

[22] Filed: Sep. 25, 1998

[51] Int. Cl.[7] ..... A63B 41/08

[52] U.S. Cl. ..... 473/604; 473/607; 473/609

[58] Field of Search ..... 473/596, 597, 473/598, 604, 607, 609

[56] References Cited

U.S. PATENT DOCUMENTS

| | | | |
|---|---|---|---|
| Re. 15,108 | 5/1921 | Fukuda . | |
| 712,412 | 10/1902 | Richards . | |
| 720,482 | 2/1903 | Richards . | |
| 736,229 | 8/1903 | Davis . | |
| 1,543,724 | 6/1925 | Roberts et al. . | |
| 2,129,237 | 9/1938 | Riddell . | |
| 2,221,533 | 11/1940 | Voit et al. . | |
| 2,287,171 | 6/1942 | Goldsmith . | |
| 2,295,815 | 9/1942 | Webb . | |
| 4,333,648 | 6/1982 | Aovama . | |
| 4,738,450 | 4/1988 | Wexler | 473/598 |
| 5,181,717 | 1/1993 | Donntag et al. . | |
| 5,306,002 | 4/1994 | Mever . | |
| 5,419,552 | 5/1995 | Mever . | |
| 5,735,761 | 4/1998 | Palmquist | 473/598 |

FOREIGN PATENT DOCUMENTS 662796 5/1963 Canada .

OTHER PUBLICATIONS

"Hoopla History—The Evolution of the Basketball and Other Hoop Essentials", B. Hill, 1990 Official NCAA Basketball Championship Guide, pp. 80–82.

"Final four balls must be best, too", USA Today Sports, E. Brady, Mar. 26, 1993, 1 page.

"Rule No. 1 Court Dimensions and Equipment", Copyright 1998 WNBA Enterprises, LLC and/or Starwave and ESPN, Inc, pp. 1–2.

"NBA Authentics Leather Composite Synthetic Rubber", Booklet, Spaulding, 1998.

"Spaulding Basketball Composite Synthetic Rubber", Booklet, 1998.

"Spaulding WNBA Products", 1998.

*Primary Examiner*—Raleigh W. Chiu

*Attorney, Agent, or Firm*—Wolf, Greenfield & Sacks, P.C.

[57] ABSTRACT

A basketball includes an inflatable bladder and a cover that surrounds the bladder. An outer surface of the basketball is substantially smooth, devoid of any seams, lines, stitching, raised or indented surface indicia, corrugation, stippling, or other surface irregularities, besides an air intake and release valve, discernable through the feel. The size and weight of the basketball may meet the specifications of at least one of the NBA, NCAA, WNBA or Youth Basketball.

22 Claims, 2 Drawing Sheets

SMOOTH BASKETBALL

FIELD OF THE INVENTION

The present invention relates generally to the game of basketball and, more particularly, to a basketball having a substantially smooth outer surface aimed at improving the shooting accuracy of players.

BACKGROUND OF THE INVENTION

Basketball has emerged as the fastest growing major sport in the United States. A recent study indicated that more than 46,000,000 Americans played basketball at least once in 1996. The sport is seeing similar growth and popularity outside the United States as well. Many are serious players; almost 13,000,000 Americans played basketball fifty times in 1996.

As is well known, the aim in the game of basketball is for a player to shoot a basketball through a "basket" (rim with attached net). Basketballs are designed to meet league (i.e., National Basketball Association [NBA], National Collegiate Athletic Association [NCAA] and Women's National Basketball Association [WNBA]) specifications and to maximize the "grip" of a player's hands on the basketball. A good grip is viewed as aiding in improving the "game" (shooting accuracy and dribbling control) of the player.

Conventional basketballs have an outer surface with a number of irregularities such as seams, corrugation and stippling. FIG. 1 shows a conventional basketball 10. As shown, basketball 10 includes an outer cover layer 12 consisting of a number of panels 12A, 12B, 12C, etc. Each panel (e.g., 12A) is separated from an adjacent panel (e.g., 12B) by a different one (e.g., 14A) of a number of seams 14A, 14B, 14C, etc. The outer surface of each panel includes corrugation and stippling. Often, basketballs also include surface indicia or labeling (not shown in the basketball of FIG. 1) on one or more of the panels, which indicia or labeling is raised or indented with respect to the outer surface of the cover layer.

It is known that some players rely on a certain orientation of the basketball and/or certain degree of grip (referred to as the "feel" of the ball) before shooting the ball. Such players practice by orienting the basketball so that their fingers grip the ball in desired locations relative to the seams and/or wait until the desired feel is achieved before shooting. Without the desired orientation and/or feel, these players arc less comfortable shooting the ball. Such shooting habits can negatively affect the game of the player, either in terms of the shooting accuracy or shooting release time of the player. This is so because often in game situations, time may not be available to orient the ball or insure a sufficient grip before shooting. In addition, poor shooting form is sometimes compensated for by too much reliance on control by the fingers. The stippling specifically permits such control.

Conventional basketballs suffer the drawback of being poor practice balls for those who have or may develop the above-mentioned shooting habits.

U.S. Pat. No. 5,306,002 to Myer discloses a basketball having a cover with an outer surface devoid of seams, stitching and indicia. The cover does, however, include uniform stippling along the entire outer surface to improve the grip of the basketball.

The basketball disclosed in the Myer patent also suffers the drawback of being a poor practice ball due to the improved grip provided by the stippling. A player may learn through practice with the Meyer basketball to rely on the improved grip and feel of the stippling prior to shooting. As noted, such reliance may negatively effect the game of the player.

It is an object of the present invention to provide a basketball having a substantially smooth outer surface, devoid of conventional basketball seams, corrugation, stippling and other surface irregularities, besides an air intake and release valve, discernable through the feel of the basketball. It is another object of the invention to provide a basketball that will force reliance upon mechanical basics of shooting other than through the fingers.

SUMMARY OF THE INVENTION

An embodiment of the invention is directed to a basketball including an inflatable inner bladder and an outer cover that surrounds the bladder. An outer surface of the basketball is free of conventional basketball seams and stipples. Preferably it is substantially smooth. By "substantially smooth", it is meant that the outer surface is free of conventional basketball seams, stitching, corrugation, stippling and other surface irregularities, except for an air intake and release valve, typically discernable through feeling the basketball with one's hand.

The basketball of the invention includes an outer surface having reduced grip when compared with conventional basketballs (those accepted for NBA, NCAA and WNBA play). The Applicant herein has discovered that players who practice shooting with the smooth surface basketball of the invention should improve their shooting accuracy and release time during game situations. By practicing with the basketball of the invention, players will not become accustomed to and develop a reliance on any particular orientation or degree of grip of the basketball during shooting. As a result, the shooting accuracy and release time of players should improve in game situations. In addition, shooting becomes less controllable through manipulation by the fingertips and more dependent upon the mechanics of proper shooting such as overall form, position and motion of the arm, including the elbow, forearm, wrist, etc.

In an embodiment of the invention, the basketball further includes at least one middle layer located between the bladder and the cover.

In an embodiment of the invention, the outer layer is made from one of rubber, leather, synthetic leather and a composite material.

In an embodiment, the basketball has an outer circumference and weight which comply with specifications of at least one of the NBA, the NCAA (men's or women's), and the WNBA.

In an embodiment, the basketball has an outer circumference substantially within a range of 29.5–30 inches and a weight substantially within a range of 20–22 ounces.

In another embodiment, the basketball has an outer circumference substantially within a range of 28.5–39 inches and a weight substantially within a range of 18–20 ounces.

In a further embodiment, the basketball has an outer circumference substantially within a range of 26.75–27.5 inches and a weight substantially within a range of 14–17.5 ounces.

In an embodiment, the basketball is inflated to a pressure less than or equal to nine pounds per square inch. In an embodiment, the pressure also is greater than or equal to seven pounds per square inch.

In another embodiment, the basketball is inflated to a pressure such that when the basketball is dropped to an indoor playing surface from a height of six feet, measured to a bottom of the basketball from the playing surface, the basketball will rebound to a height of not less than 49 inches and not more than 54 inches, measured to a top of the basketball from the playing surface.

In a further embodiment, the basketball is inflated to a pressure such that when the basketball is dropped to an indoor playing surface from a height of six feet, measured to a bottom of the basketball from the playing surface, the basketball will rebound to a height of not less than 51 inches and not more than 56 inches, measured to a top of the basketball from the playing surface.

In an embodiment, the basketball is spherical.

Another embodiment of the invention is directed to a method for forming a basketball comprising the steps of: forming an inflatable inner bladder; forming a cover having a substantially smooth outer surface; and attaching the cover to the bladder such that the cover surrounds the bladder.

BRIEF DESCRIPTION OF THE DRAWINGS

For a better understanding of the invention, reference is made to the accompanying drawings, in which.

DETAILED DESCRIPTION

The basketball of the invention has a substantially smooth outer surface, devoid of any lines, conventional basketball seams, raised or indented indicia, corrugation, stippling or other surface irregularities, besides an air intake and release valve, typically discernable through the feel of the basketball. The basketball of the invention may have a single seam produced through manufacture which, unlike conventional basketball seams, is not pronounced and blends in with remainder of the surface of the basketball. The basketball has reduced grip when compared to a conventional basketball. A number of embodiments of the basketball of the invention are disclosed.

The basketball of the invention serves as an ideal practice basketball for shooting. As a result of the smooth surface and reduced grip, a player is prevented from relying on a particular orientation of the basketball and/or high degree of surface grip before shooting. With the basketball of the invention, the player will learn to develop a "pure" shot, including good overall form, balanced arm position, release mechanics, etc. and not simply grasping and shooting the basketball while controlling it primarily by the fingertips. As such, shooting accuracy and release time should improve.

Figure 1:
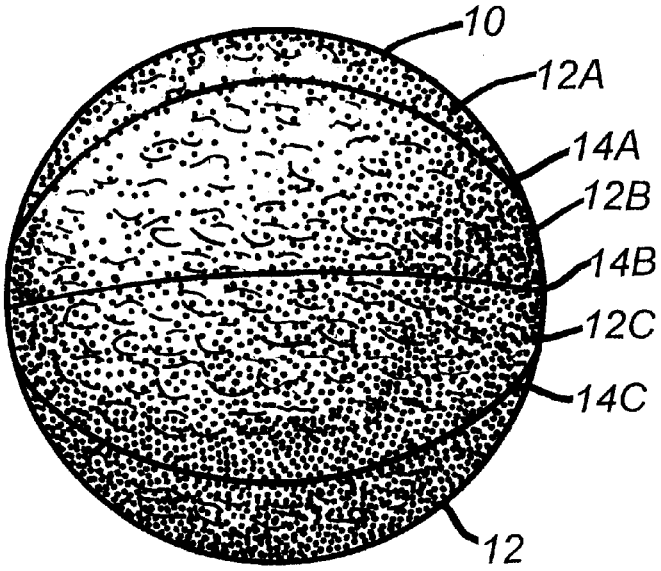
Fig. 1 (PRIOR ART)
FIG. 1 is a diagram of a prior art basketball.
Figure 2:
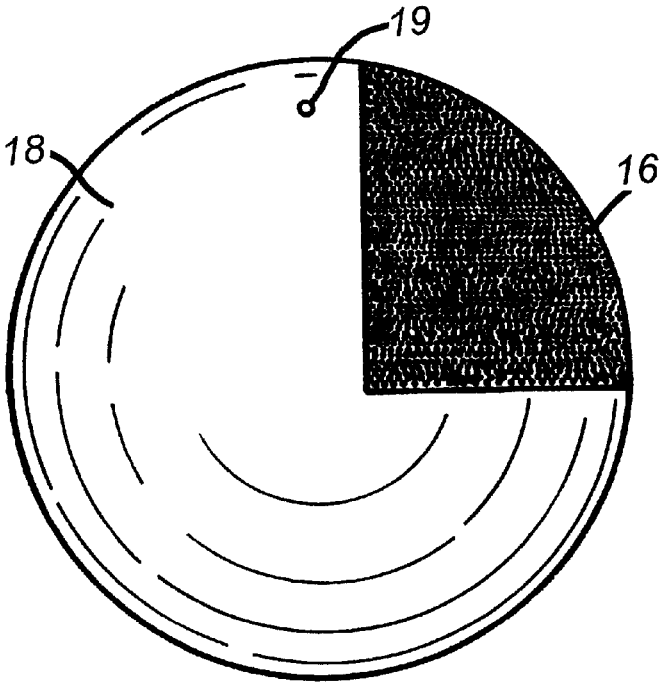
FIG. 2 is a diagram of a basketball according to one embodiment of the invention.

One embodiment of the basketball according to the invention is shown in FIG. 2. As shown, the basketball includes an inner inflatable bladder 16 surrounded by an outer cover 18. The diagram is partially cut away to expose bladder 16. The outer surface of the cover is substantially smooth, being devoid of any conventional basketball seams, lines, stitching, stippling, raised or indented indicia, corrugation, or the like.

The inner bladder 16 may be made from any now-known or later discovered materials suitable for basketball bladders. For example, the bladder may be made from an elastomeric material such as rubber.

The bladder may be made conventionally by forming the elastomeric material into a sphere and attaching thereto an air intake and release valve. In one embodiment, the bladder is formed by dye cutting a flat sheet of elastomeric material into smaller sheets which then are folded and heat sealed along their edges to form a sphere.

An air intake and release valve 19, consisting of a valve housing and valve stem, may be made conventionally from a suitable material such as butyl rubber. Valve 19 is adhered conventionally in an air-tight manner to the formed elastomeric material and cured to produce the finished bladder. The valve must be in fluid communication with the inside of the bladder.

The basketball may be conventionally inflated or deflated respectively by providing air into or releasing air from the bladder through the valve. An air pump pin may be releasably inserted into an opening in the valve for either of these purposes.

In one embodiment, the outer surface of valve 19 is made flush with the outer surface of the cover layer.

The outer cover layer 18 also may be made from any now-known or later discovered materials suitable for basketballs. For examples, the outer cover layer may be made from any one of rubber, leather, synthetic leather, and a composite material, so long as the outer surface is substantially smooth and provides a reduced surface grip.

The cover may consist conventionally of a material substrate known as "backing", and a surface coating layer known as "top coat". Each of the backing and top coat may comprise many different compositions, depending on the desired sales price and level and/or type of play (i.e., indoor vs. outdoor) for which the ball is targeted, as is conventional. By varying the backing and top coat compositions, different levels of play and durability result.

Leather traditionally has been perceived as the premier high-end basketball cover material and may be used as the material for the cover of the basketball of the invention. Typically, cowhide leather is processed for use as the cover material. During the processing, called "tanning", leather rawhides are submerged in tanning agents to impart specific physical properties to the leather. The tanning agents react with collagen fibers and proteins within the cowhide to preserve them and prevent decomposition. As a result, the tight intermingling of the collagen fibers makes the tanned leather extremely strong and durable, while the proteins take on a spongy nature to give the newly tanned leather a soft feel. The use of different types and concentrations of tanning agents allows the tanner to impart different desired physical properties (i.e., stiffness, softness, etc.), as is well known.

Composite materials, such as the ZK composite material made by Spalding Company of Chicopee, Mass., alternatively may be used. Composite materials are man-made materials which attempt to match the structure, and exhibit some of the same characteristics (i.e., softness and durability), of leather.

Alternatively, synthetic leather materials such as polyurethane or polyvinyl chloride (PVC), may be used.

The cover layer may be formed conventionally except that the outer surface of the cover will exhibit substantial smoothness and reduced grip. In one embodiment, the cover layer is pre-formed into two hollow hemispheres. The hemispheres are adhesively joined to one another and to the outer surface of the bladder. A single seam may result between the two hemispheres. Unlike conventional basketball seams, however, the resulting seam will be minimally discernible and will blend in with the remainder of the surface of the basketball. The seam may be made invisible and undiscernible through coating or bonding of the seam.

Alternatively, the outer cover layer may be formed by dipping the bladder into a liquid form of the outer cover material and then removing the bladder from the liquid cover material, allowing the cover material to dry and harden thereon.

Figure 3:
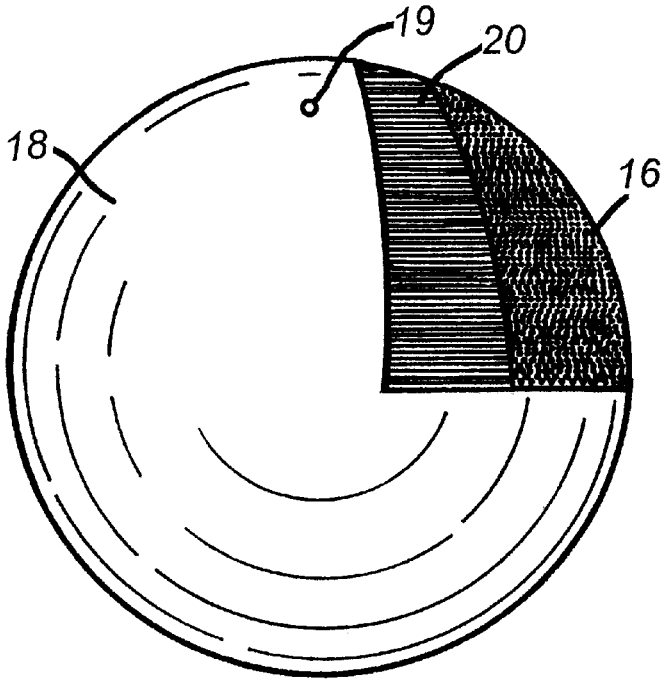
FIG. 3 is a diagram of a basketball according to another embodiment of the invention.
Figure 4:
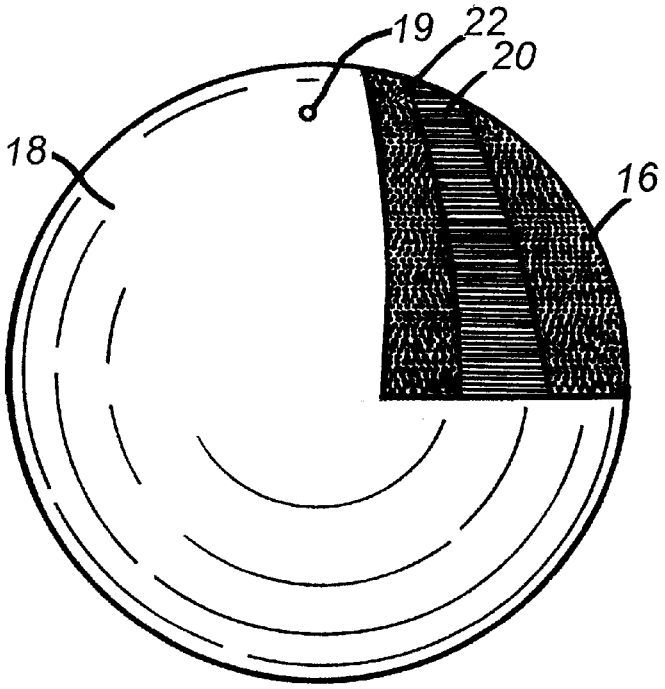
FIG. 4 is a diagram of a basketball according to a further embodiment of the invention.

Alternative embodiments of the basketball according to the invention are shown in FIGS. 3 and 4, where identical reference characters are used to refer to similar or identical elements to those shown in FIG. 2. As shown, the basketball in each of FIGS. 3 and 4 includes multiple layers. Like the basketball shown in FIG. 2, the basketball of each of these alternative embodiments includes an inner bladder 16 and an outer cover 18. Each of the bladder and cover may be formed as described with reference to FIG. 2.

The basketball of the embodiments of FIGS. 3 and 4 also includes at least one middle layer, located between the bladder and the cover. The diagrams of FIGS. 3 and 4 also are partially cut away to expose bladder 16 and the middle layer(s). In the embodiment of FIG. 3, the basketball includes a single middle layer 20 consisting of a winding of thread. In the embodiment of FIG. 4, the basketball includes two middle layers, a first winding layer 20, directly surrounding the bladder, and a second stock layer 22, covering the winding layer.

The middle layers may be formed conventionally. For example, the winding layer 20 may be formed by winding thread around the bladder, adding dimensional stability to the basketball. As is conventional, the length of the thread depends on the size and desired quality (in terms of dimensional stability and longevity) of the basketball. Typically, for a top quality basketball meeting NBA specifications, approximately 2100 meters of thread may be used. Conventional basketball winding layer thread may be used for this purpose, as is well-known.

The stock layer may be formed by molding natural rubber, or another suitable material, over the winding layer 20.

After the middle layer(s) is(are) formed, the cover is attached to the middle layer(s) either adhesively or by dipping the partially formed basketball into a liquid form of the cover layer, or other, as described above.

The cover of the basketball of the invention differs from that of the prior art in that it is free of conventional basketball seams, stitching, indicia and stippling. In general, a stippled surface must be added to the materials forming covers of the prior art, such as by molding, stamping and the like. In the present invention, the step of stippling the surface is absent. Instead, a mold, or other apparatus is used to generate a material with a substantially smooth surface, or a rough material is treated such as by polishing or the like to create a substantially smooth surface, or a material with a substantially smooth surface can be selected from the start. This is within the ability of those of ordinary skill in the art.

In one embodiment, the basketball of the invention is manufactured as described in U.S. Pat. No. 5,306,002, the entire disclosure of which is incorporated herein by reference, but using a substantially smooth instead of stippled cover material.

The basketball according to the present invention may be made in any size or weight category. Among the differently sized and weighted basketballs according the invention, it is intended that the basketballs will be made to meet the specifications of at least one of the NBA, NCAA, WNBA and Youth Basketball. Presently, the specifications for such balls are listed in the following table.

| Type | Circumference (in) | Weight (oz) | Pressure (psi) |
|---|---|---|---|
| NBA | 29.5 | 20–22 | 7–9 |
| NCAA | 29.5–30 | 20–22 | * |
| WNBA | 28.5–29 | 18–20 | ≦9 |
| Youth Basketball | 26.75–27.5 | 14–17.5 | |

*According to NCAA specifications, the basketball should be inflated to an air pressure such that when the ball is dropped indoor to a playing surface from a height of six feet, measured to the bottom of the ball from the playing surface, it will rebound to a height, measured to the top of the ball:
for men, of not less than 49 inches when it strikes the least resilient spot of the playing surface and not more than 54 inches when it strikes the most resilient spot of the playing surface; and
for women, of not less than 51 inches when it strikes the least resilient spot of the playing surface and not more than 56 inches when it strikes the most resilient spot of the playing surface.

In addition to the specifications listed above, according to NBA and NCAA requirements, the basketball should be spherical and, when dribbled vertically, without rotation, the basketball shall return in a vertical direction to the dribbler's hand.

After manufacture, each basketball of the invention will be tested to meet the above- mentioned specifications. For example, each ball will be tested for uniform roundness in multiple dimensions to ensure that the ball is a true sphere. In addition, each ball will be subjected to "drop" tests, during which the balls are dropped multiple (i.e., 6–24) times at different locations in an indoor basketball court and the rebound heights are measured, to ensure compliance with NCAA pressure requirements (see above).

As is performed by Rawlings Sporting Goods Company of St. Louis, Mo., which supplies the NCAA with its game basketballs, the basketballs according to the invention may be "slam tested", which includes whacking each basketball at a high speed (i.e., 30 miles per hour) multiple times (i.e., approximately 1200) against a wooden wall to remove any slickness from the surface of the basketball and to ensure that the ball is in "worn" (used) condition before undergoing the drop test.

Some retail outlets subject their basketballs to "drop" tests to ensure the balls perform adequately before selling them. For example, Champion Sporting Goods of Boston, Mass., performs the following drop test on each basketball it sells. Each ball is held by a person in one hand with his/her arm extended above his/her head. If the ball bounces to approximately to the waist level of the person, then the ball is considered to be inflated to an appropriate pressure and adequate to sell. Otherwise, the pressure of the ball is adjusted until the ball meets the drop test standard.

The basketball according to the invention may be made in any color, including a color accepted for NCAA, NBA or WNBA play. At present, the NBA and NCAA require a basketball in a shade of orange. Team indicia are accepted on the basketballs and may be stamped or otherwise provided on the basketball of the invention so long as the outer surface remains substantially smooth. In addition, the NCAA requires that the pressure in psi of the basketball be stamped on the outer surface of the basketball. Such information also may be stamped or otherwise provided on the outer surface of the basketball of the invention so long as the outer surface remains substantially smooth.

It should be appreciated that the basketball of the invention, and each of the layers thereof, may be made according to any now-known or later-developed process and the invention is not limited to the particular processes described. Similarly, each of the layers of the basketball of the invention may be made from any now-known or later-developed material and the invention is not limited to the particular materials described.

Having thus described at least one illustrative embodiment of the invention, various alterations, modifications and improvements will readily occur to those skilled in the art. Such alterations, modifications and improvements are intended to be within the spirit and scope of the invention. Accordingly, the foregoing description is by way of example only and is not intended as limiting. The invention is limited only as defined in the following claims and the equivalents thereto

What is claimed is:

1. A basketball comprising:

an inflatable inner bladder; and a cover that surrounds the bladder, wherein an outer surface of the cover is free of conventional basketball seams and stipples; and wherein the basketball is a completed basketball product for use in a game of basketball.

2. The basketball as claimed in claims 1 wherein the outer surface is substantially smooth.

3. The basketball as claimed in claim 1 further including at least one middle layer located between the bladder and the cover.

4. The basketball as claimed in claim 1 wherein the cover is made from one of rubber, leather, synthetic leather and a composite material.

5. The basketball as claimed in claim 1 wherein the basketball has an outer circumference substantially within a range of 29.5–30 inches and a weight substantially within a range of 20–22 ounces.

6. The basketball as claimed in claim 1 wherein the basketball has an outer circumference substantially within a range of 28.5–29 inches and a weight substantially within a range of 18–20 ounces.

7. The basketball as claimed in claim 1 wherein the basketball has an outer circumference substantially within a range of 26.75–28 inches and a weight substantially within a range of 14–17.5 ounces.

8. The basketball as claimed in claim 1 wherein the basketball is inflated to a pressure less than or equal to nine pounds per square inch.

9. The basketball as claimed in claim 8 wherein the pressure is greater than or equal to seven pounds per square inch.

10. The basketball as claimed in claim 1 wherein the basketball is inflated to a pressure such that when the basketball is dropped to an indoor playing surface from a height of six feet measured to a bottom of the basketball, the basketball will rebound to a height of not less than 49 inches and not more than 54 inches measured to a top of the basketball.

11. The basketball as claimed in claim 1 wherein the basketball is inflated to a pressure such that when the basketball is dropped to an indoor playing surface from a height of six feet measured to a bottom of the basketball, the basketball will rebound to a height of not less than 51 inches and not more than 56 inches measured to a top of the basketball.

12. The basketball as claimed in claim 1 wherein the basketball is spherical.

13. A method for forming a basketball comprising the steps of:

forming an inflatable inner bladder;

forming a cover having a substantially smooth outer surface; and attaching the cover to the bladder such that the cover surrounds the bladder; such that the basketball formed is a completed basketball product for use in a game of basketball.

14. The method as claimed in claim 13 further including a step of forming at least one middle layer between the bladder and the cover.

15. The method as claimed in claim 13 wherein the step of forming the cover includes the step of forming the cover from one of rubber, leather, synthetic leather and a composite material.

16. The method as claimed in claim 13 wherein the basketball has an outer circumference substantially within a range of 29.5–30 inches and a weight substantially within a range of 20–22 ounces.

17. The method as claimed in claim 13 wherein the basketball has an outer circumference substantially within a range of 28.5–29 inches and a weight substantially within a range of 18–20 ounces.

18. The method as claimed in claim 13 wherein the basketball has an outer circumference substantially within a range of 26.75–28 inches and a weight substantially within a range of 14–17.5 ounces.

19. The method as claimed in claim 13 further including a step of inflating the basketball to a pressure less than or equal to nine pounds per square inch.

20. The method as claimed in claim 19 wherein the pressure also is greater than or equal to seven pounds per square inch.

21. The method as claimed in claim 13 further including a step of inflating the basketball to a pressure such that when the basketball is dropped to an indoor playing surface from a height of six feet measured to a bottom of the basketball, the basketball will rebound to a height of not less than 49 inches and not more than 54 inches measured to a top of the basketball.

22. The method as claimed in claim 13 further including a step of inflating the basketball to a pressure such that when the basketball is dropped to an indoor playing surface from a height of six feet measured to a bottom of the basketball, the basketball will rebound to a height of not less than 51 inches and not more than 56 inches measured to a top of the basketball.

* * * * *